US005965347A

United States Patent [19]

Bauer et al.

[11] Patent Number: 5,965,347

[45] Date of Patent: Oct. 12, 1999

[54] THERMALLY PROCESSABLE IMAGING ELEMENT HAVING IMPROVED PHYSICAL PROPERTIES

[75] Inventors: Charles L. Bauer, Webster; Dorothy T. Java, Fairport, both of N.Y.

[73] Assignee: Eastman Kodak Company, Rochester, N.Y.

[21] Appl. No.: 08/979,315

[22] Filed: Nov. 26, 1997

[51] Int. Cl.[6] ..... G03C 1/496

[52] U.S. Cl. ..... 430/619; 430/617

[58] Field of Search ..... 430/617, 619

[56] References Cited

U.S. PATENT DOCUMENTS

| | | | |
|---|---|---|---|
| 3,893,860 | 7/1975 | Sutton et al. . | |
| 4,188,212 | 2/1980 | Fujiwara et al. | 430/69 |
| 4,705,736 | 11/1987 | Notley . | |
| 5,468,603 | 11/1995 | Kub . | |
| 5,527,758 | 6/1996 | Uyttendaele et al. . | |

FOREIGN PATENT DOCUMENTS

| | | |
|---|---|---|
| 51 034714 | 3/1976 | Japan . |
| 1422145 | 1/1976 | United Kingdom . |

OTHER PUBLICATIONS

Encyclopedia of Polymer Science and Engineering, H. Mark et al., eds., vol. 17, p. 156, J. Wiley and Sons, N.Y., 1989.

*Primary Examiner*—Thorl Chea
*Attorney, Agent, or Firm*—Edith A. Rice

[57] ABSTRACT

A thermally processable imaging element which comprises a support bearing an imaging layer containing in reactive association an image-forming combination comprising an organic silver salt oxidizing agent with a reducing agent for the organic silver salt oxidizing agent, wherein the imaging layer comprises a binder and a chlorinated hydrocarbon.

5 Claims, No Drawings

THERMALLY PROCESSABLE IMAGING ELEMENT HAVING IMPROVED PHYSICAL PROPERTIES

FIELD OF THE INVENTION

This invention relates to thermally processable imaging elements having improved physical properties.

BACKGROUND OF THE INVENTION

Thermally processable imaging elements typically comprise a support bearing an imaging layer and various other layers such as backing, subbing and overcoat layers. The imaging element in a thermally processable imaging element typically is comprised of a mixture of a polymeric binder (such as poly(vinylbutyral)) with a variety of imaging components such as silver behenate, reducing agents and developers.

It is known to add various additives to the layers of thermally processable imaging elements. Such additives include plasticizers as disclosed, for example, in U.S. Pat. Nos. 3,893,860 5,468,603 and U.S. Pat. No. 5,527,758.

The use of plasticizers in polyvinyl butyral is known. For example *Encyclopedia of Polymer Science and Engineering*, H. Mark et al, eds, Vol 17, p. 156, J. Wiley and Sons, New York, 1989, teaches that a "wide variety of plasticizers is suitable for polyvinyl(butyral)," suggesting specific materials such as phthalates, phosphates, fatty acid esters, and polyester based materials as useful plasticizers.

It is also known to add plasticizers to other imaging elements. For example, U.S. Pat. No. 4,705,736 describes the use of plasticizers in a thermally developable diazotype film. The incorporation of the plasticizer increases development speeds during thermal processing.

PROBLEM TO BE SOLVED BY THE INVENTION

Thermally processable imaging elements have a tendency to scratch, for example, from pressure from an external point source or from transport mechanisms feeding the element into position for exposure or thermal processing. To protect the imaging element, a protective overcoat is applied to the layer. However, this overcoat may not provide sufficient scratch protection under severe usage. This invention addresses the problem of improving the scratch resistance of a thermally processable imaging element.

SUMMARY OF THE INVENTION

We have found that the addition of chlorinated hydrocarbon plasticizers to the imaging layer of a thermally processable imaging element improves the scratch resistance of the element. The chlorinated hydrocarbon may have at least 8 carbon atoms, preferably 12 to 30 carbon atoms. The preferred chlorinated hydrocarbon has 12 carbon atoms.

Accordingly, this invention comprises a thermally processable imaging element comprising a support bearing an imaging layer containing in reactive association an image-forming combination comprising an organic silver salt oxidizing agent with a reducing agent for the organic silver salt oxidizing agent, wherein the imaging layer comprises a binder and a chlorinated hydrocarbon.

ADVANTAGEOUS EFFECT OF THE INVENTION

This invention provides thermally processable imaging elements having improved scratch resistance.

DETAILED DESCRIPTION OF THE INVENTION

The thermally processable imaging element of this invention can be of the type in which an image is formed by imagewise heating of the element or of the type in which an image is formed by imagewise exposure to light followed by uniform heating of the element. The latter type of element is commonly referred to as a photothermographic element.

The thermally processable imaging element comprises an imaging layer containing the appropriate imaging materials (as discussed more fully below) in a binder. The binder is preferably a high molecular weight material and resin include poly(vinyl butyral), cellulose acetate butyrate, poly (methylmethacrylate), poly(vinylpyrrolidone), ethyl cellulose, polystyrene, poly(vinylchloride), chlorinated rubbers, polyisobutylene, butadiene-styrene copolymers, copolymers of vinyl chloride and vinyl acetate, copolymers of vinylidene chloride and vinyl acetate, poly(vinyl alcohol) and polycarbonates. To obtain the necessary imaging characteristics this layer typically contains less than 50% by weight binder.

In accordance with this invention a chlorinated hydrocarbon having at least 8 carbon atoms is added to the imaging layer. Preferred chlorinated hydrocarbons have 12 to 30 carbon atoms. The preferred chlorinated hydrocarbon has 12 carbon atoms. The amount of chlorinated hydrocarbon added to the imaging layer is about 2.5 to about 25%, more preferably about 5 to about 15% and most preferably about 8 to about 12% by weight, based on the weight of the binder.

The thermally processable imaging element of the invention comprises at least one imaging layer containing in reactive association an image-forming combination comprising (i) an organic silver salt oxidizing agent, preferably a silver salt of a long chain fatty acid, such as silver behenate, with (ii) a reducing agent for the organic silver salt oxidizing agent, preferably a phenolic reducing agent, and (c) an optional toning agent. Photothermographic elements of the invention further comprise photographic silver halide prepared in situ and/or ex situ,References describing such imaging elements include, for example, U.S. Pat. Nos. 3,457,075; 4,459,350; 4,264,725 and 4,741,992 and *Research Disclosure*, June 1978, Item No. 17029, the entire disclosures of which are incorporated herein by reference.

Photothermographic elements typically comprise a photosensitive component that consists essentially of photographic silver halide. In the photothermographic material it is believed that the latent image silver from the silver halide acts as a catalyst for the described image-forming combination upon processing. A preferred concentration of photographic silver halide is within the range of 0.01 to 10 moles of photographic silver halide per mole of silver behenate in the photothermographic material. Other photosensitive silver salts are useful in combination with the photographic silver halide if desired. Preferred photographic silver halides are silver chloride, silver bromide, silver bromochloride, silver bromoiodide, silver chlorobromoiodide, and mixtures of these silver halides. Very fine grain photographic silver halide is especially useful. The photographic silver halide can be prepared by any of the known procedures in the photographic art. Such procedures for forming photographic silver halides and forms of photographic silver halides are described in, for example, *Research Disclosure*, December 1978, Item No. 17029 and *Research Disclosure*, June 1978, Item No. 17643, the entire disclosures of which are incorporated herein by reference . Tabular grain photosensitive silver halide is also useful, as described in, for example, U.S. Pat. No. 4,435,499, the entire disclosure of which is incorporated herein by reference. The photographic silver halide can be unwashed or washed, chemically sensitized, protected against the formation of fog, and stabilized against the loss of sensitivity during keeping as described in the above Research Disclosure publications. The silver halides can be prepared in situ as described in, for example, U.S. Pat. No. 4,457,075 the entire disclosure of which is incorporated herein by reference, or prepared ex situ by methods known in the photographic art.

The photothermographic element typically comprises an oxidation-reduction image forming combination that contains an organic silver salt oxidizing agent, preferably a silver salt of a long chain fatty acid. Such organic silver salts are resistant to darkening upon illumination. Preferred organic silver salt oxidizing agents are silver salts of long chain fatty acids containing 10 to 30 carbon atoms. Examples of useful organic silver salt oxidizing agents are silver behenate, silver stearate, silver oleate, silver laurate, silver hydroxystearate, silver caprate, silver myristate, and silver palmitate. Combinations of organic silver salt oxidizing agents are also useful. Examples of useful organic silver salt oxidizing agents that are not organic silver salts of fatty acids are silver benzoate and silver benzotriazole.

The optimum concentration of organic silver salt oxidizing agent in the photothermographic element will vary depending upon the desired image, particular organic silver salt oxidizing agent, particular reducing agent and particular photothermographic element. A preferred concentration of organic silver salt oxidizing agent is within the range of 0.1 to 100 moles of organic silver salt oxidizing agent per mole of silver halide in the element. When combinations of organic silver salt oxidizing agents are present, the total concentration of organic silver salt oxidizing agents is preferably within the described concentration range.

A variety of reducing agents are useful in the photothermographic element. Examples of useful reducing agents in the image-forming combination include substituted phenols and naphthols, such as bis-beta-naphthols; polyhydroxybenzenes, such as hydroquinones, pyrogallols and catechols; aminophenols, such as 2,4-diaminophenols and methylaminophenols; ascorbic acid reducing agents, such as ascorbic acid, ascorbic acid ketals and other ascorbic acid derivatives; hydroxylamine reducing agents; 3-pyrazolidone reducing agents, such as 1-phenyl-3-pyrazolidone and 4-methyl-4-hydroxymethyl-1-phenyl-3-pyrazolidone; and sulfonamidophenols and other organic reducing agents known to be useful in photothermographic elements, such as described in U.S. Pat. No. 3,933,508, U.S. Pat. No. 3,801,321 and *Research Disclosure*, June 1978, Item No. 17029, the entire disclosures of which are incorporated herein by reference . Combinations of organic reducing agents are also useful in the photothermographic element.

Preferred organic reducing agents in the photothermographic element are sulfonamidophenol reducing agents, such as described in U.S. Pat. No. 3,801,321, the entire disclosure of which is incorporated herein by reference. Examples of useful sulfonamidophenol reducing agents are 2,6-dichloro-4-benzene-sulfonamidophenol; benzenesulfonamidophenol; and 2,6-dibromo-4-benzenesulfonamidophenol, and combinations thereof.

An optimum concentration of organic reducing agent in the photothermographic element varies depending upon such factors as the particular photothermographic element, desired image, processing conditions, the particular organic silver salt and the particular oxidizing agent.

The thermally processable elements as described preferably contain various colloids and polymers alone or in combination as vehicles and binders and in various layers. Useful materials are hydrophilic or hydrophobic. They are transparent or translucent and include both naturally occurring substances, such as gelatin, gelatin derivatives, cellulose derivatives, polysaccharides, such as dextran, gum arabic and the like; and synthetic polymeric substances, such as water-soluble polyvinyl compounds like poly (vinylpyrrolidone) and acrylamide polymers. Other synthetic polymeric compounds that are useful include dispersed vinyl compounds such as in latex form and particularly those that increase dimensional stability of photographic elements. Effective polymers include water insoluble polymers of acrylates, such as alkylacrylates and methacrylates, acrylic acid, sulfoacrylates, and those that have cross-linking sites. Preferred high molecular weight materials and resins include poly(vinyl butyral), cellulose acetate butyrate, poly(methylmethacrylate), poly (vinylpyrrolidone), ethyl cellulose, polystyrene, poly (vinylchloride), chlorinated rubbers, polyisobutylene, butadiene-styrene copolymers, copolymers of vinyl chloride and vinyl acetate, copolymers of vinylidene chloride and vinyl acetate, poly(vinyl alcohol) and polycarbonates.

Photothermographic elements and thermographic elements as described can contain addenda that are known to aid in formation of a useful image. The photothermographic element can contain development modifiers that function as speed increasing compounds, sensitizing dyes, hardeners, antistatic agents, plasticizers and lubricants, coating aids, brighteners, absorbing and filter dyes, such as described in *Research Disclosure*, December 1978, Item No. 17643 and *Research Disclosure*, June 1978, Item No. 17029, the entire disclosures of which are incorporated herein by reference.

The photothermographic element preferably comprises a toning agent, also known as an activator-toner or toner-accelerator. Combinations of toning agents are also useful in the photothermographic element. Examples of useful toning agents and toning agent combinations are described in, for example, *Research Disclosure*, June 1978, Item No. 17029 and U.S. Pat. No. 4,123,282, the entire disclosures of which are incorporated herein by reference . Examples of useful toning agents include, for example, phthalimide, N-hydroxyphthalimide, N-potassium-phthalimide, succinimide, N-hydroxy-1,8-naphthalimide, phthalazine,1-(2H)-phthalazinone and 2-acetylphthalazinone.

Post-processing image stabilizers and latent image keeping stabilizers are useful in the photothermographic element. Any of the stabilizers known in the photothermographic art are useful for the described photothermographic element. Illustrative examples of useful stabilizers include photolytically active stabilizers and stabilizer precursors as described in, for example, U.S. Pat. No. 4,459,350. Other examples of useful stabilizers include azole thioethers and blocked azolinethione stabilizer precursors and carbamoyl stabilizer precursors, such as described in U.S. Pat. No. 3,877,940.

The thermally processable element can comprise a variety of supports. Examples of useful supports are poly (vinylacetal) film, polystyrene film, poly(ethylene terephthalate) film, poly(ethylene naphthalate) film, polycarbonate film, and related films and resinous materials, as well as paper, glass, metal, and other supports that withstand the thermal processing temperatures.

The layers of the thermally processable element are coated on a support by coating procedures known in the photographic art, including dip coating, air knife coating, curtain coating or extrusion coating using hoppers. If desired, two or more layers are coated simultaneously.

Spectral sensitizing dyes are useful in the photothermographic element to confer added sensitivity to the element. Useful sensitizing dyes are described in, for example, *Research Disclosure*, June 1978, Item No. 17029 and *Research Disclosure*, December 1978, Item No. 17643.

A photothermographic element as described preferably comprises a thermal stabilizer to help stabilize the photothermographic element prior to exposure and processing. Such a thermal stabilizer provides improved stability of the photothermographic element during storage. Preferred thermal stabilizers are 2-bromo-2-arylsulfonylacetamides, such as 2-bromo-2-p-tolysulfonylacetamide; 2-(tribromomethyl sulfonyl)benzothiazole; and 6-substituted-2,4-bis (tribromomethyl)-s-triazines, such as 6-methyl or 6-phenyl-2,4-bis(tribromomethyl)-s-triazine.

The thermally processable elements are exposed by means of various forms of energy. In the case of the photothermographic element such forms of energy include those to which the photographic silver halides are sensitive and include ultraviolet, visible and infrared regions of the electromagnetic spectrum as well as electron beam and beta radiation, gamma ray, x-ray, alpha particle, neutron radiation and other forms of corpuscular wave-like radiant energy in either non-coherent (random phase) or coherent (in phase) forms produced by lasers. Exposures are monochromatic, orthochromatic, or panchromatic depending upon the spectral sensitization of the photographic silver halide. Imagewise exposure is preferably for a time and intensity sufficient to produce a developable latent image in the photothermographic element.

After imagewise exposure of the photothermographic element, the resulting latent image is developed merely by overall heating the element to thermal processing temperature. This overall heating merely involves heating the photothermographic element to a temperature within the range of about 90° C. to 180° C. until a developed image is formed, such as within about 0.5 to about 60 seconds. By increasing or decreasing the thermal processing temperature a shorter or longer time of processing is useful. A preferred thermal processing temperature is within the range of about 100° C. to about 140° C.

In the case of a thermographic element, the thermal energy source and means for imaging can be any imagewise thermal exposure source and means that are known in the thermographic imaging art. The thermographic imaging means can be, for example, an infrared heating means, laser, microwave heating means or the like.

Heating means known in the photothermographic and thermographic imaging arts are useful for providing the desired processing temperature for the exposed photothermographic element. The heating means is, for example, a simple hot plate, iron, roller, heated drum, microwave heating means, heated air or the like.

Thermal processing is preferably carried out under ambient conditions of pressure and humidity. Conditions outside of normal atmospheric pressure and humidity are useful.

The components of the thermally processable element can be in any location in the element that provides the desired image. If desired, one or more of the components can be in one or more layers of the element. For example, in some cases, it is desirable to include certain percentages of the reducing agent, toner, stabilizer and/or other addenda in the overcoat layer over the photothermographic imaging layer of the element. This, in some cases, reduces migration of certain addenda in the layers of the element.

It is necessary that the components of the imaging combination be "in association" with each other in order to produce the desired image. The term "in association" herein means that in the photothermographic element the photographic silver halide and the image forming combination are in a location with respect to each other that enables the desired processing and forms a useful image.

A photothermographic element typically has a transparent protective layer complising a film forming binder, preferable a hydrophilic film forming binder. Such binders include, for example, crosslinked polyvinyl alcohol, gelatin, poly(silicic acid), and the like. Particularly preferred are binders comprising poly(silicic acid) alone or in combination with a water-soluble hydroxyl-containing monomer or polymer as described in the U.S. Pat. No. 4,828,971, the entire disclosure of which is incorporated herein by reference.

The term "protective layer" is used in this application to mean a transparent, image insensitive layer that can be an overcoat layer, that is a layer that overlies the image sensitive layer(s), or a backing layer, that is a layer that is on the opposite side of the support from the image sensitive layer (s). The imaging element can contain an adhesive interlayer between the protective layer and the underlying layer(s). The protective layer is not necessarily the outermost layer of the imaging element.

The protective layer can contain an electrically conductive layer having a surface resistivity of less than $5\times10^{11}$ ohms/square. Such electrically conductive overcoat layers are described in U.S. Pat. No. 5,547,821, the entire disclosure of which is incorporated herein by reference.

A photothermographic imaging element generally includes at least one transparent protective layer containing matte particles. Either organic or inorganic matte particles can be used. Examples of organic matte particles are often in the form of beads, of polymers such as polymeric esters of acrylic and methacrylic acid, e.g., poly (methylmethacrylate), styrene polymers and copolymers, and the like. Examples of inorganic matte particles are of glass, silicon dioxide, titanium dioxide, magnesium oxide, aluminum oxide, barium sulfate, calcium carbonate, and the like. Matte particles and the way they are used are further described in U.S. Pat. Nos. 3,411,907, 3,754,924, 4,855,219, 5,279,934, 5,288,598, 5,378,577, and commonly assigned copending patent applications Ser. No. 08/421,178 filed Apr. 13, 1995, and U.S. Ser. No. 08/330,406, filed Oct. 28, 1994, the entire disclosures of which are incorporated herein by reference.

A wide variety of materials can be used to prepare the protective backing layer that is compatible with the requirements of photothermographic elements. The protective layer should be transparent and should not adversely affect sensitometric characteristics of the photothermographic element such as minimum density, maximum density and photographic speed. Useful protective layers include those comprised of poly(silicic acid) and a water-soluble hydroxyl containing monomer or polymer that is compatible with poly(silicic acid) as described in U.S. Pat. Nos. 4,741,992 and 4,828,971, the entire disclosures of which are incorporated herein by reference. A combination of poly(silicic acid) and poly(vinyl alcohol) is particularly useful. Other useful protective layers include those formed from polymethylmethacrylate, acrylamide polymers, cellulose acetate, crosslinked polyvinyl alcohol, terpolymers of acrylonitrile, vinylidene chloride, and 2-(methacryloyloxy)

ethyl-trimethylammonium methosulfate, crosslinked gelatin, polyesters and polyurethanes.

Particularly preferred protective layers are described in above-mentioned U.S. Pat. Nos. 5,310,640 and 5,547,821, the entire disclosures of which are incorporated herein by reference.

EXAMPLE 1

Comparison A

A thermally processable imaging element was prepared by coating a blue (0.14 density) poly(ethylene terephthalate) support, having a thickness of 0.178 mm, with a photothermographic imaging layer and a protective overcoat. The layers of the thermally processable imaging element are coated on a support by coating procedures known in the photographic art, including dip coating, air knife coating, slot coating, curtain coating or extrusion coating using hoppers. The photothermographic imaging composition was coated from a solvent mixture containing 73.5% 2-butanone, 11.0% toluene, 15% methanol and 0.5% Dowanol at a wet coverage of 75.3 cc/m$^2$ to form an imaging layer of the following dry composition:

TABLE 1

Photothermographic Imaging Layer

| Components | Dry Coverage (g/m$^2$) |
|---|---|
| Succinimide | 0.143 |
| Phthalimide | 0.572 |
| Poly-dimethyl siloxane (General Electric SP-96-200) | 0.007 |
| 2-bromo-2-((4-methylphenyl)sulfonyl)acetamide | 0.105 |
| Naphthyl triazine | 0.025 |
| Palmitic acid | 0.127 |
| N-(4-hydroxyphenyl)-benzenesulfonamide | 1.716 |
| Silver, as silver bromide | 0.460 |
| B-15708 sensitizing dye | 0.004 |
| Silver, as silver behenate | 9.372 |
| Polyvinyl butyral, M.W. 90,000–120,000 (Monsanto Butvar B-76, 11–13% hydroxyl content) | 5.148 |
| Trimethyl Borate | 0.088 |
| Sodium Iodide, USP | 0.000 |
| Mercury, as mercuric bromide | 0.001 |

The resulting imaging layer was then overcoated with mixture of polyvinyl alcohol and hydrolyzed tetraethyl orthosilicate as described in Table 2 at a wet coverage of 40.4 cc/m$^2$ and dried.

TABLE 2

Overcoat Solution

| Component | Grams |
|---|---|
| Distilled Water | 226.4 |
| Polyvinyl Alcohol (PVA, Elvanol 52-22 from DuPont, 86–89% hydrolyzed) (6.2% by weight in distilled water) | 443.0 |
| Tetraethyl Orthosilicate (35.4% by weight in methanol/water (53:47)) | 251.6 |
| p-Toluene Sulfonic Acid (1 N solution in distilled water) | 3.1 |
| Olin 10G (10% by weight in distilled water. (Olin 10G is para-isononylphenoxy polyglycidol and is a trademark of and available from the Olin Corp., U.S.A.) | 10.0 |
| Silica (1.5 micron) | 3.0 |

Comparison B

This sample is similar to Comparison A except that 8.635 g/m$^2$ (dry coverage) of Butvar B-76 and 0.146 g/m$^2$ of trimethylborate were used in the emulsion and the sample was coated at a wet coverage of 88.6 cc/m$^2$.

Invention C

This sample is similar to Comparison B except that 0.129 g/m$^2$ of Chlorwax-65, a chlorinated hyrdocarbon (or paraffin) from Occidental Chemical Corp, (2.5 wt % based on the amount of Butvar) was added to the emulsion layer as a plasticizer.

Invention D

This sample is similar to Comparison B except that 0.257 g/m$^2$ of Chlorwax-65, a chlorinated hydrocarbon (or paraffin) from Occidental Chemical Corp, (5 wt % based on the amount of Butvar) was added to the emulsion layer as a plasticizer.

Invention E

This sample is similar to Comparison B except that 0.515 g/m$^2$ of Chlorwax-65, a chlorinated hydrocarbon (or paraffin) from Occidental Chemical Corp, (10 wt % based on the amount of Butvar) was added to the emulsion layer as a plasticizer.

Invention F

This sample is similar to Comparison B except that 0.515 g/m$^2$ of Paroil-150A, a chlorinated hydrocarbon (or paraffin) from Dover Chemical Corp., (10 wt % based on the amount of Butvar) was added to the emulsion layer as a plasticizer.

After preparation these samples were evaluated for both sensitometric performance and scratch resistance.

The effect of the plasticizer on sensitometry was determined by measuring Dmin, relative speed and Dmax of each sample after writing the appropriate density image with a 683 nm laser and thermally processing at 123° C. for 5 sec. Invention samples C through F, had equivalent Dmins and either equivalent or slightly increased speeds and Dmax relative to the comparison coatings A and B.

The scratch resistance of the coatings was evaluated using a single arm scratch test (SAS). Before scratch testing the samples are Dmax processed to provide a uniform density for test comparison. The test uses a loaded 3 mil sapphire stylus to scratch the sample at a series of loads: 100, 80, 60, 40, 30, 20, 10, and 5 grams. The sample is scratched over a 2.8 cm length at each of the loads which is repeated 3 times for each load. The scratch severity is obtained by determining the minimum load to create the first continuous plow on greater than 75% of the scratched area covered by the stylus (reported in units of grams to plow). For evaluation, the samples are viewed on a lighted viewbox. Improved scratch resistance would then be indicated by an increase in the load reported in the SAS test.

Table 3 summarizes the SAS test results for the samples prepared. The data indicates that improved scratch resistance is obtained when chlorinated hydrocarbons are added to the emulsion at levels greater than 2.5 wt % based on the amount of polymer binder.

| Sample | SAS Result (g to plow) |
|---|---|
| Comparison A | 60 |
| Comparison B | 85 |
| Invention C | 80 |
| Invention D | 98 |
| Invention E | 95 |
| Invention F | 95 |

EXAMPLE 2

In this example, Comparison B and Invention E samples were repeated. In addition another sample, Comparison G, was prepared similar to Invention E, except that 10 wt % dibutyl phthalate (0.151 g/m$^2$), a non-chlorinated plasticizer was used. The SAS results are summarized in Table 4.

| Sample | Plasticizer | SAS (g to plow) |
|---|---|---|
| Comparison B | none | 60 |
| Invention E | 10% Chlorowax 65 | 80 |
| Comparison G | 10% dibutyl phthalate | 60 |

These results show that only the chlorinated plasticizer improves the scratch resistance of the sample.

The invention has been described in detail with particular reference to preferred embodiments, but it will be understood that variations and modifications can be effected within the spirit and scope of the invention.

What is claimed is:

1. A thermally processable imaging element comprising a support bearing an imaging layer containing in reactive association an image-forming combination comprising an organic silver salt oxidizing agent with a reducing agent for the organic silver salt oxidizing agent, wherein the imaging layer comprises a binder and a chlorinated hydrocarbon having at least 8 carbon atoms.

2. An imaging element according to claim 1, wherein the chlorinated hydrocarbon has 12 to 30 carbon atoms.

3. An imaging element according to claim 1, wherein the imaging layer comprises a binder of poly(vinyl butyral).

4. An imaging layer according to claim 1, wherein the chlorinated hydrocarbon is present in an amount of 2.5 to about 25%, by weight, based on the weight of the binder.

5. An imaging element in accordance with claim 1 wherein the imaging element is a photothermographic imaging element and further comprises a silver halide emulsion.

* * * * *